US005884336A

United States Patent [19]

Stout

[11] Patent Number: 5,884,336

[45] Date of Patent: Mar. 23, 1999

[54] COLD WEATHER MASK INCLUDING A MOUTH SEAL HAVING A DIRECT FLOW THROUGH POROUS HYGROSCOPIC MATERIAL

[76] Inventor: Kathleen K. Stout, 141 Mt. Lebanon Dr., Wheeling, W. Va. 26003

[21] Appl. No.: 879,976

[22] Filed: Jun. 20, 1997

[51] Int. Cl.[6] ..... A42B 1/18

[52] U.S. Cl. ..... 2/206; 2/9; 128/206.13; 128/205.27

[58] Field of Search ..... 2/206, 9, 171.2, 2/171.3, 173; 128/205.27, 205.28, 206.12, 206.13, 206.15

[56] References Cited

U.S. PATENT DOCUMENTS

| | | | |
|---|---|---|---|
| 3,276,445 | 10/1966 | Langdon | 128/205.27 |
| 3,768,100 | 10/1973 | Colman . | |
| 4,136,691 | 1/1979 | Ebelling . | |
| 4,325,365 | 4/1982 | Barbuto . | |
| 4,458,679 | 7/1984 | Ward . | |
| 4,620,537 | 11/1986 | Brown . | |
| 4,705,033 | 11/1987 | Halfpenny . | |
| 4,825,474 | 5/1989 | Edwards | 2/206 |
| 4,856,508 | 8/1989 | Tayebi | 128/206.12 |
| 4,941,467 | 7/1990 | Takato . | |
| 5,022,394 | 6/1991 | Chmielinski . | |
| 5,331,957 | 7/1994 | Liu | 128/206.15 |
| 5,435,299 | 7/1995 | Langman . | |
| 5,562,092 | 10/1996 | George | 128/206.15 X |
| 5,595,173 | 1/1997 | Dodd . | |
| 5,660,174 | 8/1997 | Jacobelli . | |

*Primary Examiner*—Gloria M. Hale

[57] ABSTRACT

A flexible mouth seal having a porous direct flow hygroscopic material associated with a cold weather mask. The nose has free breathing and does not breath in or out through the hygroscopic material. The cold weather mask and mouth seal captures some of the moisture in exhaled air by a porous hygroscopic material and returns the moisture to the dry cold inhaled air for assistance in cold weather breathing.

8 Claims, 5 Drawing Sheets

COLD WEATHER MASK INCLUDING A MOUTH SEAL HAVING A DIRECT FLOW THROUGH POROUS HYGROSCOPIC MATERIAL

BACKGROUND

This invention relates to a cold weather mask for use outside during cold weather.

At the present time there is on the market ski masks, other head coverings and wind resistant face masks that keep the face warm and dry when outside in cold weather. Some of the ski masks have small holes over the mouth for mouth breathing and over the nose for free nose breathing. There is nothing included in these masks presently on the market, so far as is known to applicant, that facilitates humidifying cold air before it reaches into the lungs. This is an important consideration especially for those who are exerting themselves, such as runners, during cold weather conditions. Runners indicate that when they run in weather below 32 degrees F. they cannot run as long or as hard as they would normally because the cold air gives a burning sensation into the lungs. This is a syndrome called "frozen lungs" which actually is the lining of the lungs and the trachea going into the lungs failing to produce the amount of mucus to keep the lining functioning properly. A suitable and practical cold weather mask having the ability to humidify the cold air being breathed in is not only of importance to outdoor athletes, runners, bikers, hikers, skiers and outdoor workers, such is also of great importance to asthmatics and to older people who wish to perform outdoor activities in cold weather such as shoveling the snow.

SUMMARY OF THE INVENTION

The problem with cold dry air is that it dries out the inner lining of the lungs. The nose is an actual humidifier. When inhaled cold air is breathed through the nose, normal humidification would usually occur. However, in extremely cold weather, even the nose is not very effective in humidifying the incoming air and if a person is doing any type of exercise or exertion during cold weather a greater volume of air is needed to satisfy the oxygen requirements in the blood. Under these circumstances a person will start breathing through the mouth. Runners indicate that they change from nose breathing mode to a mouth breathing mode as soon as they pick up their pace and need more volume of air, primarily through their mouth. Since the mouth does not have as much moisture and humidifying affect as the nose passageways, the inhaled cold air means the greater volume of dry cold air handled through the mouth causes discomfort. As an example, a runner who has just returned from a run in cold weather has severe discomfort for several minutes after his run while waiting to rehumidify his lungs.

With respect to persons having asthmatic conditions, they are very sensitive to cold weather because their lungs are very sensitive to any type of change in temperature, so dry cold air is very irritating. Asthmatic patients are so sensitive that it is known that cold weather can trigger an attack immediately.

As to older people, many feel that they cannot go out in the cold at all since their airways have been compromised due to their age. Their bodies are not producing the amount of fluids that are required to keep their lungs in working condition for normal oxygen transport.

While there have been many efforts in the past as represented by the patent literature, no one has provided a suitable cold weather mask that includes a mouth seal which has a direct flow of incoming air through a hygroscopic porous material associated directly with the mouth seal in front of the mouth to permit humidification of the cold air intake while at the same time permitting free breathing through the nose directly into the air in a manner that requires that the air to or from the nose is not required to pass through the hygroscopic material and mouth seal.

The hygroscopic material used in the mouth seal has a high degree of porosity to permit ready exhalation and inhalation of air directly from the mouth through the material with minimum pressure drop. The hygroscopic material can be any suitable material such as calcium chloride for absorbing moisture from the exhaled air and return moisture to the inhaled dry cold air. When breathing out through the mouth the moisture in the breath is "bound" to the hygroscopic material and, during the next inhalation, the cold dry air is "conditioned" with the humidity in the hygroscopic material thus increasing the incoming air's moisture content and to facilitate normal humidification levels in the lungs. There is also some heat transfer when the moisture is absorbed by the hygroscopic material during exhalation which heat is added to the incoming air during inhalation as the moisture is absorbed into the air. The preferred hygroscopic material is a bonded highly porous filter of polypropylene which is coated with calcium chloride as a hygroscopic material and is made by ARC Medical, Inc. of 322 Patterson Avenue, Scottdale, Ga. 30079, as a part of their THERMAFLOW system. The hygroscopic filter like material is approximately ⅝ inch thick and 2 inches in diameter.

Generally the temperatures in which the mouth seal is effective are those below 32 degrees F. That's a point when many runners make a cutoff. They say they can deal with the air quality down to 32 degrees F. but when it gets below that point and it is freezing, they begin to notice a more difficult time when breathing the cold dry air through their mouth.

Those suffering from asthma and older people who are fearful of venturing out in cold weather would also be affected by breathing the cold dry air when it is hovering above 32 degrees F. or higher.

During breathing of cold air, using the mouth seal, the nose is left open so there is free breathing when using the nose for inhaling and exhaling air.

The hygroscopic material is replaceable, but generally the material being utilized will last up to seven days, if the daily use is for a period of one to two hours. Obviously this would change depending on the amount of exertion, the dryness of the air and other parameters.

Generally, the mouth seal will be included with a cold weather mask for further insulation. This mask may also include an insulating material preferably for covering at least the cheeks, lower part of the nose and the ears of the wearer. The mask may also include integral or separate covering for the top of the head.

The features, objects and advantages of the invention will become apparent to those skilled in the art from the following detailed description of the preferred embodiment, especially when considerd in conjunction with the accompanying drawings in which like numerals and the sub reviews refer to the corresponding parts.

DETAILED DESCRIPTION OF THE PREFERRED EMBODIMENT

Figure 1:
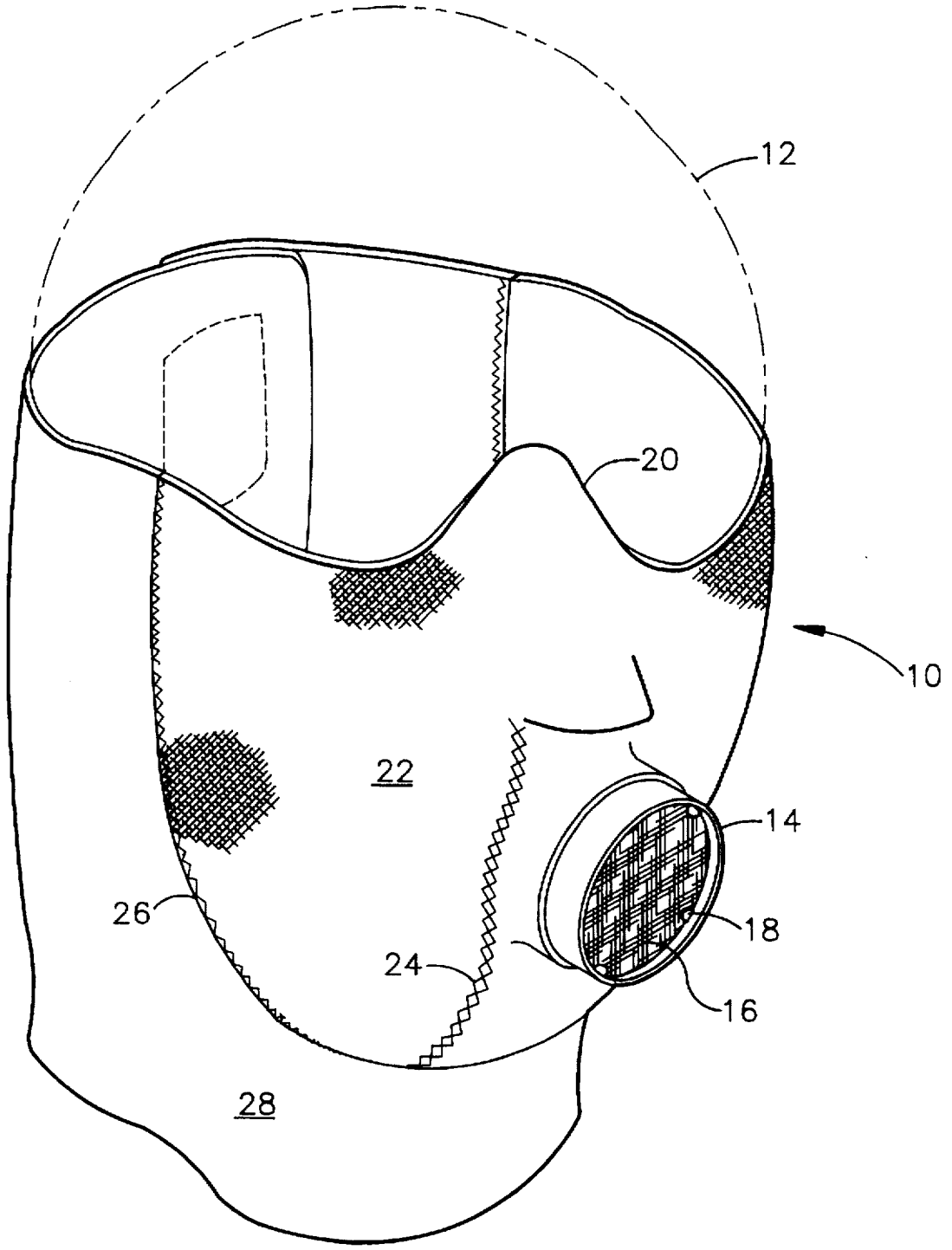
FIG. 1 is a perspective view of the cold weather mask and hygroscopic material holder.

Reference to FIG. 1, there is shown the cold weather mask 10 mounted on the head of a wearer 12 whose head is shown in dotted lines. The mask has a holder 14 centrally located in front of the mouth of the wearer. The holder shows a hygroscopic material 16 mounted within the holder 14. The preferred material has been mentioned earlier and is a batte or filter of bonded polypropylene coated fibers having a calcium chloride hygroscopic material coated on the fibers that is approximately two inches in diameter and ⅝ inch thick. Such material is highly porous and offers minimum resistence to exhaling and inhaling air. As shown, the filter 16 with hygroscopic material is pushed from the outside into the holder 14 and kept in position by four tabs 18. In the cold weather mask shown, openings are left for goggles and a separate head piece if desired. In the preferred embodiment, the mask has a nose piece 20 that covers the nose and especially the lower nose portion. It is shown in FIG. 1 that the nose free breathes directly into the air. The nose covering is part of the front piece 22 which has wind breaking characteristics as well as insulating characteristics and is preferrably formed from a closed celled neoprene rubber having a soft inner and outer liner. The front piece has one or more seams 24 for shaping it into position. The front piece is attached by means of seam 26 to the remainder part of the cold weather hood 28. The remainder part 28 is preferably made of a soft insulating material such as Polar Fleece. Polar Fleece or similar materials may also be used for the front piece. The remainder part 28 that covers the ears should not substantially diminish sound passing through the part. Both the front piece 22 and remainder 28 of the cold weather mask if made of conventional materials readily available to those in the industry and may be varied as to the choice as desired.

Figure 2:
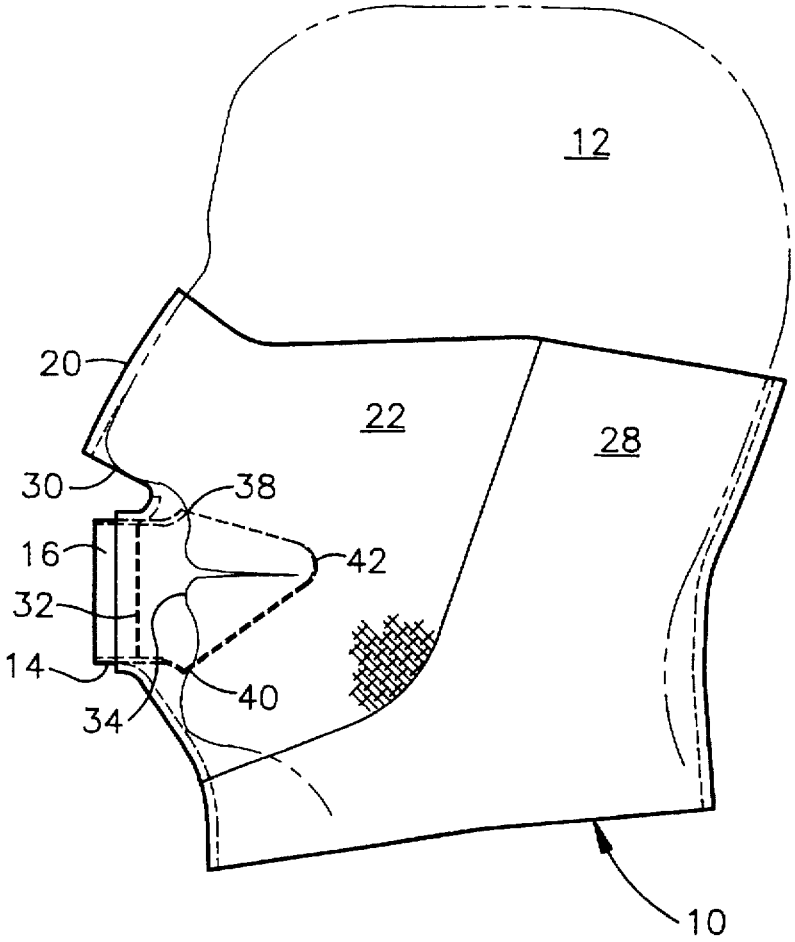
FIG. 2 is a side view of the mask and hygroscopic material holder shown mounted on a wearer's head.

With reference to FIG. 2, there is a side view of a wearer's head 12 with the cold weather mask 10 in position. The nose covering 20 as an integral part of front piece 22. The remainder part 28 depicted readily shows that the nose opening 30 permits free breathing from the nose into the air without being any constraints such as passing through a hygroscopic material. The holder 14 is shown in cross section with the hygroscopic material filter 16 in the front thereof. At the rear of the hygroscopic material filter 16 there is a highly perforated separation wall to prevent the hygroscopic material filter from contacting the lips 34 of the wearer and spaces the hygroscopic material filter directly in front thereof for directly receiving exhaled and inhaled air through the lips. The flexible mouth seal 36 serves to cover the entire mouth region. The top part 38 of the seal contacts the face between the nose and the top part of the upper lip and the bottom part 40 contacts the face between the bottom lip and the point of the chin. The left side of the flexible mouth seal 42 extends to the left beyond the edge of the lips and a similar view not shown in FIG. 2 as right side 44 extending on the other side of the lips. Both the left side and the right side are sometimes referred to herein as a first side and a second side. The flexible mouth seal is critical to the invention and directs exhaled and inhaled air through the lips directly through the hygroscopic material.

Figure 3:
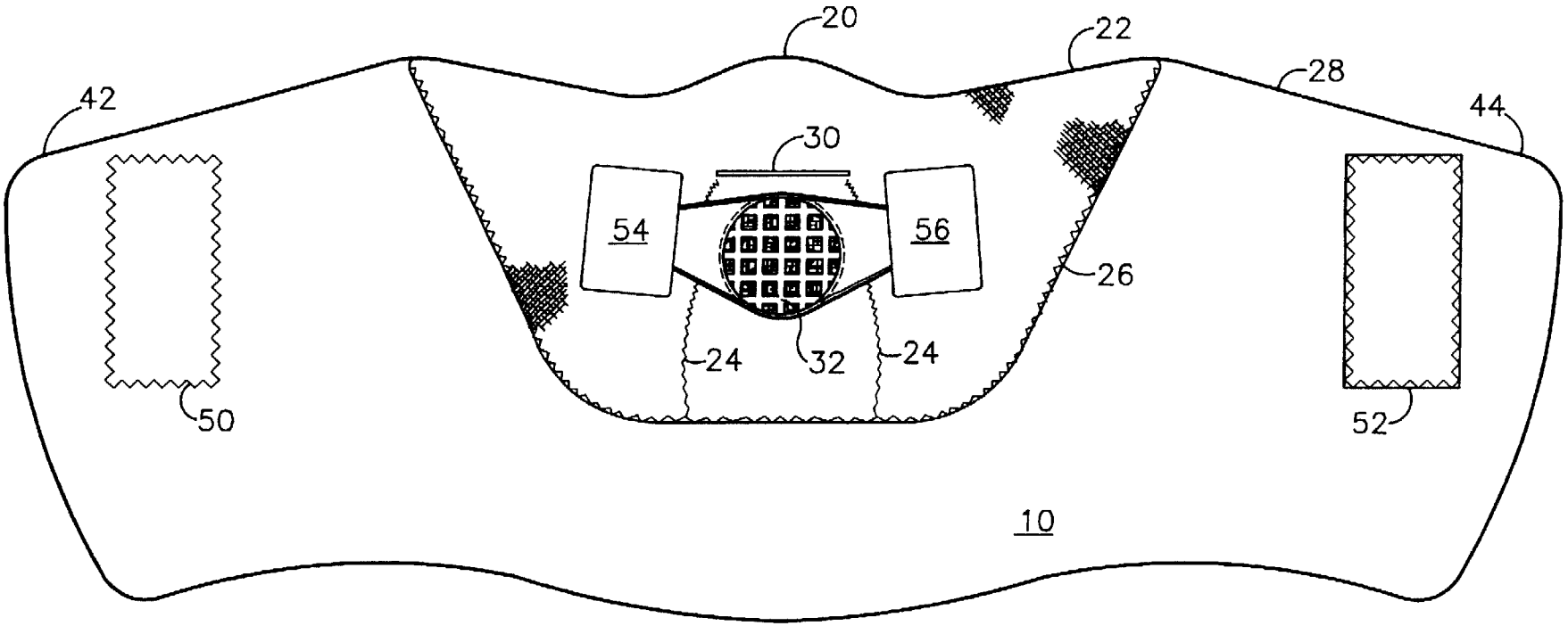
FIG. 3 is an inside view of the cold weather mask as it is laid out in a flat position.

With reference to FIG. 3 the cold weather mask 10 is viewed from the inside as it is laid out flat. The windshield insulating layer front piece 22 is seamed along lines 26 to the remainder part 28 of the mask. The nose covering 20 is in the center and the remainder part 28 has both a left extension 46 and a right extension 48 which wrap around the head of the wearer and overlap in the rear. When they overlap they are preferably held together by a fastening arrangement which is preferably two patches of complimentary Velcro with one member being the hook part and the other member being the part the hooks fit into. Obviously, one is on the inside and one on the outside of the extensions at the overlap. The two patches of Velcro are sewn to the left side extension 42 and right extension 44 and because of their area permit readily adjustment of the tightness of the cold weather mask when it is fitted on the head.

In the central part of the cold weather mask there are two holding tabs, a left holding tab 54 and a right holding tab 56 which are sewn or otherwise affixed to the front of the cold weather mask on the inside thereof. The two holding tabs are sewn on three sides with the facing side open so that the left side extension 42 and right side extension 44 of the flexible mouth seal 36 can be inserted between the tabs and the front part of the cold weather mask. Also seen in FIG. 3 is the highly perforated separation wall 32 mentioned earlier and the nose opening 30.

Figure 4:
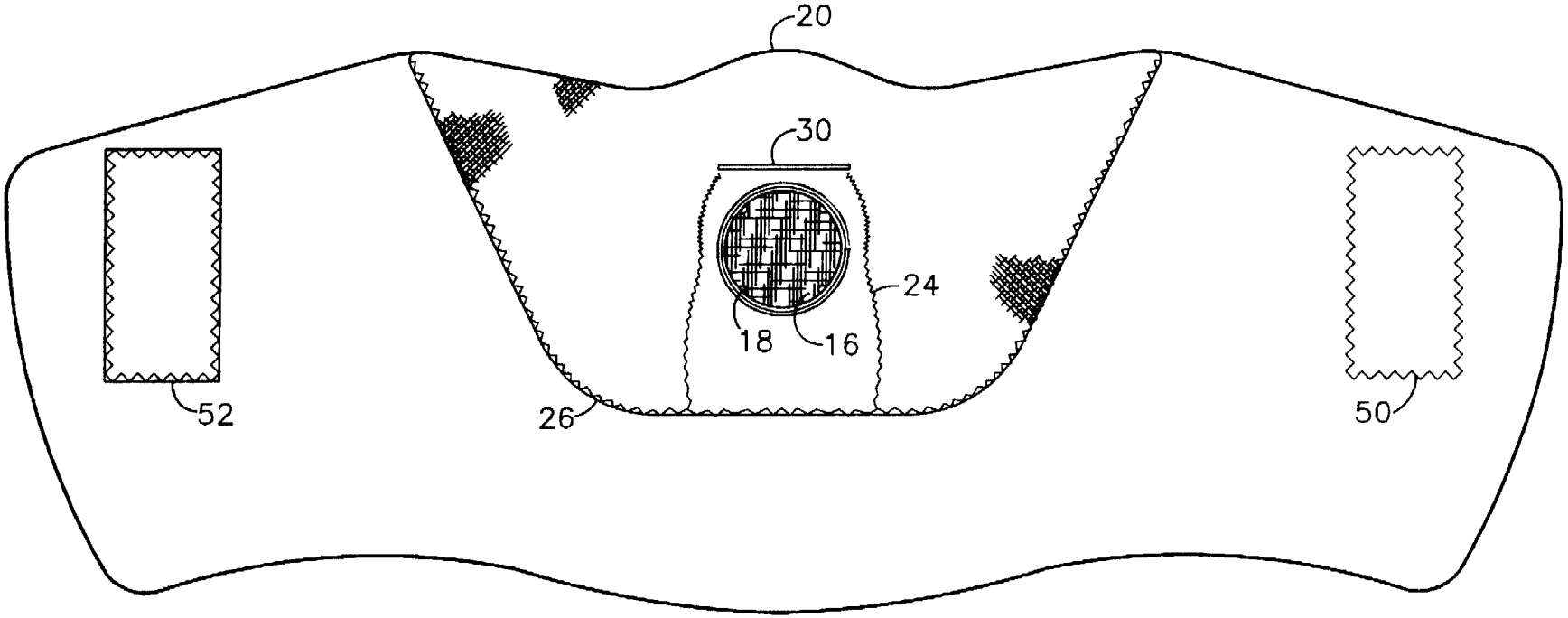
FIG. 4 is a front view of the cold weather mask of FIG. 3 which has been laid out in a flat position.

With reference to FIG. 4 there is a similar view to FIG. 3 with the cold weather mask laid flat so that the front side or outside is viewed. In this view there is shown the hygroscopic material filter 16 and the tabs 18 holding it in position.

Figure 5:
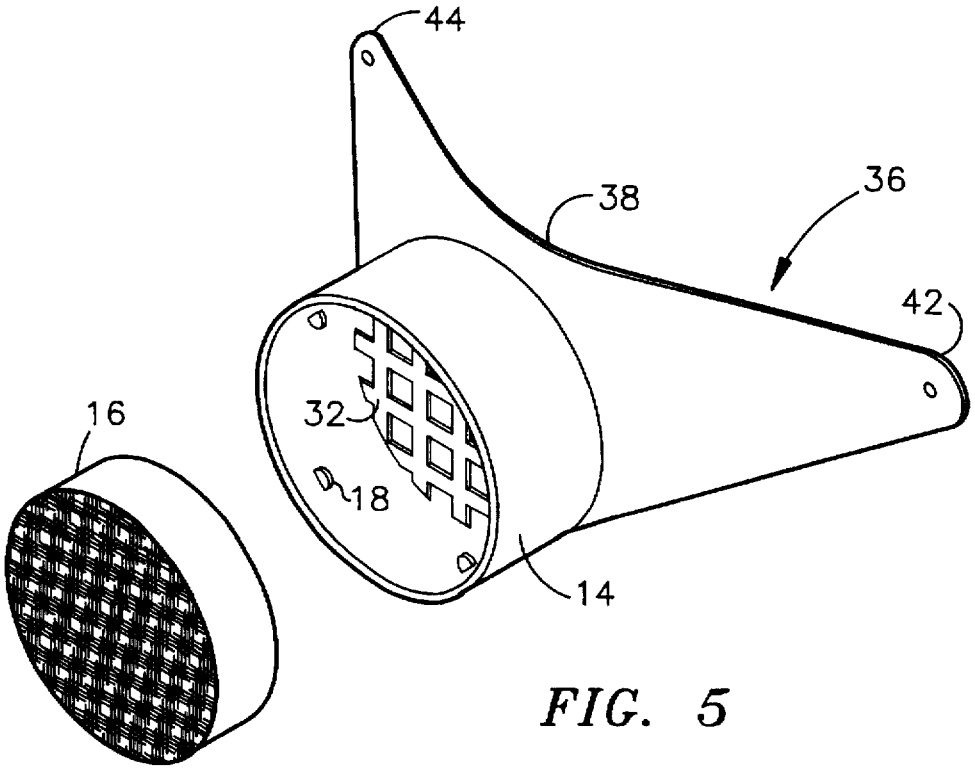
FIG. 5 is a an exploded perspective view of the flexible mouth seal and holder together with the hygroscopic material.

With reference to FIG. 5 there is shown an exploded perspective view of the flexible mouth seal 36, a left side extension 42 and right side extension 44. The flexible mouth seal 36 is important to the invention and serves to seal all around the mouth from a point beneath the nose and above the upper lip to extensions beyond the left and right side of the mouth and to a bottom point that rests between the lower lip and a point of the chin. The mouth seal is made of a flexible material that readily conforms to the dimensions of a wearer's face to fit outside the mouth and can be made of a number of suitable materials such as silicone rubber and other flexible plastics. Carried directly in the middle of the flexible mouth seal is a holder 14 for retaining the hygroscopic material filter 16. Preferably the holder 14 and the flexible mouth seal 36 are separate from the cold weather mask but it is recognized that either or both can be integrated with the mask if such is desired. Also, in some applications the flexible mouth seal 36 and its associated hygroscopic material filter 16 can be used separately and held to a wearer's head by a suitable fastening arrangement. This, for some wearers, may be a preferred choice if they do not wish a face or head covering. Normally, however the flexible mouth seal and hygroscopic material will be associated with a cold weather mask in combination therewith. Also, it should be recognized that the separate hygroscopic material filter and flexible mouth seal can be used with other head covering and front face coverings in a separated fashion without being designed to fit in a combination.

Figure 6:
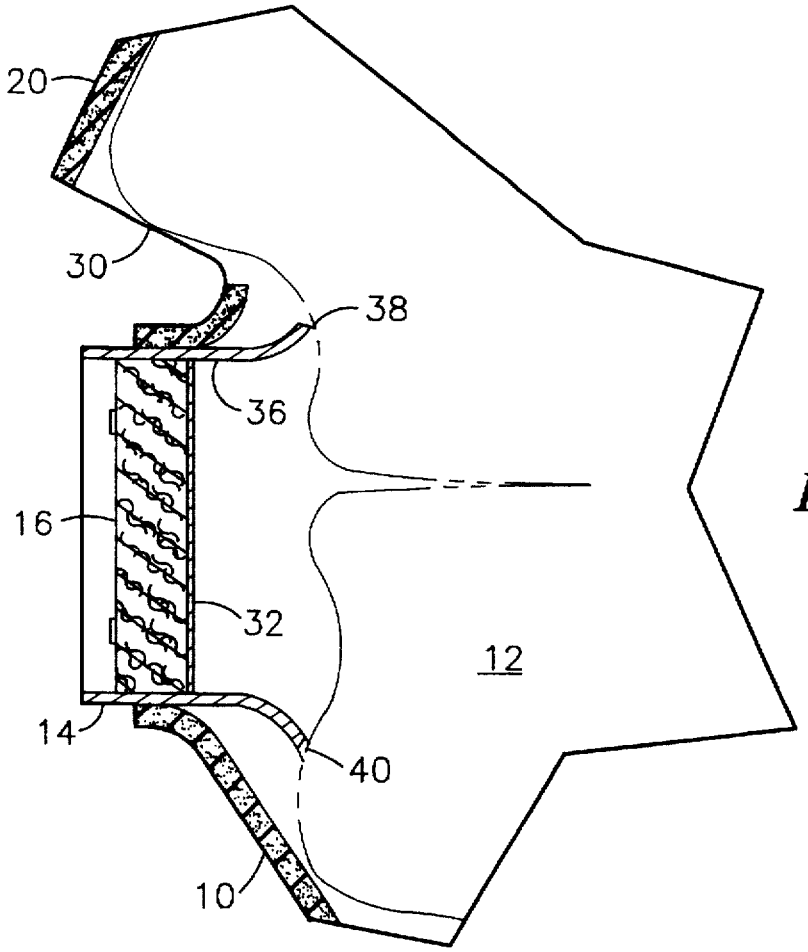
FIG. 6 is an enlarged partial cross-sectional view showing the relationship between the cold weather mask, the flexible mouth seal, the holder and the hygroscopic material.
Figure 7:
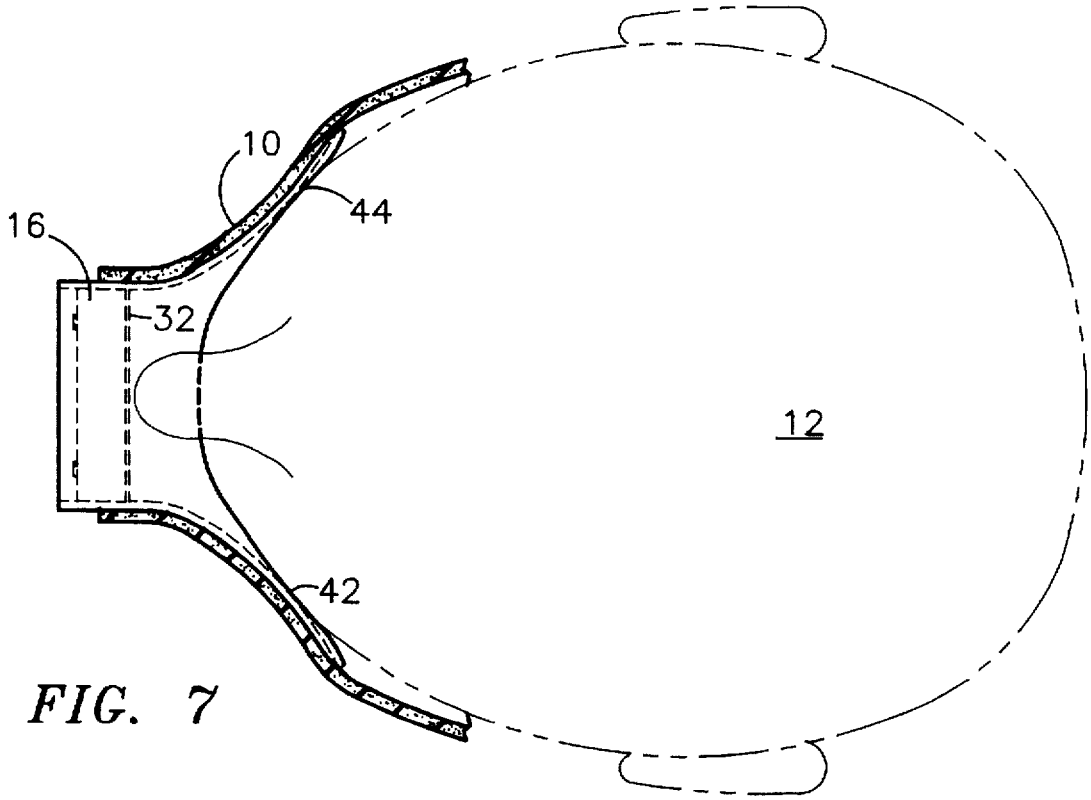
FIG. 7 is a top sectional view similar to FIG. 6.

With reference to FIGS. 6 and 7, there are two enlarged partial views of a part of the cold weather mask and the flexible mouth seal associated with the nose and lips of a wearer. These views clearly illustrate the cold weather mask 10 provides the nose covering 20 and nose opening 30 for free flow of air to the nose. Also, it is seen that the flexible mouth seal 36 contacts the face of the wearer at a top part 38, a bottom part 40, a left side extension 42 and right side extension 44 to provide a seal around and outside of the entire lip region and to permit the ready exhalation and inhalation of air through the holder 14 and its hygroscopic material filter 16 and highly perforated separating wall 32 so there is very little resistence to the movement of the air. As is seen in the views, the hygroscopic material and holder 14 are spaced in front of the lips or mouth a suitable distance to not interfere with movement of the mouth but permit the exhalation and inhalation directly through the hygroscopic material in a straight line.

While the holder 14 and flexible mouth seal are should in one piece, the holder can be a separate piece that is attached to the rest of the mouth seal.

The invention has been described herein to provide those skilled in the art with information needed to apply its features and to utilize such components as are required. However, it is to be understood that the invention can be carried out by specifically different mechanisms and materials without departing from the scope of the invention itself.

What is claimed is:

1. A flexible mouth seal having a top part, a bottom part, a first side and a second side for surrounding the lips of a wearer comprising:

said top part of said flexible mouth seal for contacting the wearer between the nose and the upper lip;

said bottom part of said flexible mouth seal for contacting the wearer beneath the lower lip;

said first side of said flexible mouth seal being curved to accommodate and contact a first side of the lips of a wearer beyond a first edge of said lips;

said second side of said flexible mouth seal being curved to accommodate and contact a second side of the lips of the wearer beyond a second edge of said lips;

a holder centrally, located in said flexible mouth seal directly in front of a wearer's lips and spaced therefrom;

a fastening arrangement for said flexible mouth seal for fastening said flexible mouth seal to the head of a wearer; and a porous hygroscopic material in said holder for absorbing moisture from exhaled air from the wearer and for returning moisture to inhaled air.

2. The flexible mouth seal of claim 1 which further includes:

an insulated face mask containing said flexible mouth seal which covers at least around the mouth and cheeks of a wearer; and said fastening arrangement includes extensions on said insulated mask that terminate at the back of the head of the wearer with said fasteners located near the end of said extensions.

3. The flexible mouth seal of claim 2 wherein:

said insulated mask and said flexible mouth seal are separate members with said insulated mask including a seal attachment arrangement for connecting said flexible mouth seal to said insulated mask.

4. The flexible mouth seal of claim 2 wherein:

said insulated mask includes an insulated nose cover that permits free breathing directly into the air of the wearer.

5. The flexible mouth seal of claim 4 wherein:

said insulated mask includes an insulated cover for the ears which permits sound to be transferred to the ears.

6. The flexible mouth seal of claim 5 wherein:

said extensions of said insulated mask includes an extension on each side of the head of a wearer with complimentary fasteners connecting said extensions together.

7. The flexible mouth seal of claim 1 wherein said hygroscopic material is in the form of a plastic fiber filter having a hygroscopic material on the surface of said fibers.

8. A flexible mouth seal having a top part, a bottom part, a first side and a second side for surrounding the lips of a wearer comprising:

said top part of said flexible mouth seal for contacting the wearer between the nose and the upper lip;

said bottom part of said flexible mouth seal for contacting the wearer beneath the lower lip;

said first side of said flexible mouth seal being curved to accommodate and contact a first side of the lips of a wearer beyond a first edge of said lips;

said second side of said flexible mouth seal being curved to accommodate and contact a second side of the lips of the wearer beyond a second edge of said lips;

a holder centrally located in said flexible mouth seal directly in front of a wearer's lips and spaced therefrom;

a fastening arrangement for said flexible mouth seal for fastening said flexible mouth seal to the head of a wearer; and a porous hygroscopic material in said holder for absorbing moisture from exhaled air from the wearer and for returning moisture to inhaled air.

* * * * *